United States Patent [19]

Dacey, Jr.

[11] Patent Number: 4,932,128

[45] Date of Patent: Jun. 12, 1990

[54] MECHANICAL FORCE ENHANCER

[75] Inventor: Ernest A. Dacey, Jr., Highland, Mich.

[73] Assignee: Utica Enterprises, Inc., Sterling Heights, Mich.

[21] Appl. No.: 289,025

[22] Filed: Dec. 23, 1988

[51] Int. Cl.[5] ..... B26F 1/00

[52] U.S. Cl. ..... 30/362; 71/89.15; 30/358

[58] Field of Search ..... 30/358, 362, 277, 272 K; 83/320; 74/89.15

[56] References Cited

U.S. PATENT DOCUMENTS

| | | | |
|---|---|---|---|
| 3,380,160 | 4/1968 | Kirchberger et al. | 30/362 |
| 3,453,914 | 7/1969 | Lemper et al. | 83/320 X |
| 3,680,400 | 8/1972 | Lemper et al. | 74/89.15 |
| 3,925,891 | 12/1975 | Devilbiss | 30/362 |
| 4,301,723 | 11/1981 | Borzym | 83/320 X |

*Primary Examiner*—Frank T. Yost
*Assistant Examiner*—Willmon Fridie, Jr.
*Attorney, Agent, or Firm*—Remy J. VanOphem

[57] ABSTRACT

A mechanical force enhancer for the amplification of a force generated by a pneumatic cylinder that is mounted at one end of a pair of spaced apart side plates. A piston rod attached to the pneumatic cylinder is in turn connected to a translatable link that is guided partially by complementary grooves contained in the side plates. After the link has translated through a prescribed distance, the end thereof most remote from the cylinder rod end is stopped against translatory movement thus permitting the link to rotate. A tool containing ram is attached to the link intermediate the stopped end and the rod attachment end. The continued rotation of the link provides an amplification of the force delivered by the cylinder ram thus permitting the tool to do useful work.

24 Claims, 5 Drawing Sheets

MECHANICAL FORCE ENHANCERBACKGROUND OF THE INVENTION

1. FIELD OF THE INVENTION

The present invention relates to a mechanical device for the enhancement of a linear force. More particularly, the invention involves a force delivered by a pneumatic cylinder, wherein the load output of the pneumatic cylinder is amplified and, also, wherein there is provided sufficient adjustment of the tool to permit the overall apparatus to be engaged and disengaged with a variety of workpieces requiring a variety of strokes.

2. DESCRIPTION OF THE PRIOR ART

The prior art reveals a wide variety of mechanical devices for the enhancement of a force delivered by hand, hydraulic and other means. In general, a small input force is translated into a relatively larger output force. The initial force is commonly generated by the application of a fluid driven device that employs a work medium such as oil or air.

The present invention is an improvement over the force multiplying mechanism shown and described in U.S. Pat. No. 3,680,400 entitled "Force-Multiplying Mechanisms" issued Aug. 1, 1972, to Herbert Lemper et al. The above referenced patent describes a device for the shearing of metal blooms that are of large cross-sectional area. Consequently, the movable shear blade has to travel a considerable distance in order to effect a clean and complete shearing of the bloom. The power for the shearing action is delivered by a drive shaft that has an eccentrically mounted pitman arm that is coupled to a knife block. The coupling between the pitman arm and the knife block is made by a screw mechanism contained primarily within the knife block. The screw mechanism has an independent power source that is actuated in synchronism with the oscillation of the pitman arm. On the power stroke, the pitman arm advances the shear blade a short distance. Normally, on the return stroke of the pitman arm the shear blade would reverse its direction of travel, however, the screw mechanism within the knife block maintains the position of the shear blade until it can be advanced another incremental distance on the next power stroke of the pitman arm. Thus, there are two forces that are alternatively applied to the knife blade. First, there is the larger force generated by the pitman arm and, second, there is the smaller force applied by the screw mechanism.

The present invention also applies a large and a small force to a tool carrying ram. However, the mechanism employed by the present invention is much simpler than the mechanism set forth in U.S. Pat. No. 3,680,400. Also, the ram of the present invention utilizes a single power source.

U.S. Pat. No. 3,417,599 issued Dec. 24, 1968, entitled "Compressing Tool" to William C. Burns describes and shows a crimping tool that delivers two different loads through the action of a single actuator rod. The actuator rod moves, under the influence of leveraged hand operated handles, to compress a series of Belleville washers. The twin array of Belleville washers delivers a compressive load to one portion of a crimping head. An adjacent portion of the crimping head receives a lesser load because this portion of the crimping head is under the influence of a weaker set of Belleville washers.

Thus, a fastener that is subjected to the crimping tool described in U.S. Pat. No. 3,417,599 receives two different crimping forces through the action of the crimping tool handles.

The present invention differs from the hand operated crimper described in U.S. Pat. No. 3,417,599 in that a first load is applied to a ram to move it through a larger distance. A second load is then applied to the ram to move it through a lesser distance. A single pneumatic cylinder rod is utilized to create each of the ram loading conditions.

In U.S. Pat. No. 4,442,581 entitled "Button Puncher or Crimper" issued to Melvin Molnick, a crimping device is shown and described. The crimping device or tool is quite portable and relies primarily on a pantograph configuration for developing a mechanical advantage that permits the jaws of the tool to perform useful work. In one particular embodiment of the invention, shown in FIG. 4, a hydraulic cylinder is used to apply the actuating force to the tool. A mechanical advantage is achieved through the use of a sliding fulcrum point identified by numeral 44. The direction of travel of the fulcrum 44 is linear throughout its entire traverse.

Other linear free enhancement devices are known in the prior art, for example, Benetear, U.S. Pat. No. 4,099,436 teaches an hydraulic piercing device wherein a punch is driven by a cylinder and piston. The arrangement is such that a small pressure applied to a second piston results in a large force applied by the punch to the sheet material. The lower piston is at first activated by compressed hydraulic fluid until it makes contact with the work. The upper piston which is activated by compressed air travels towards the lower piston so that its piston rod entraps the pressurized hydraulic fluid above the lower piston, and proceeds to add its own pressure to the pressure already acting upon the lower piston. The entire action is controlled by a delayed action valve and a four way valve.

The present invention differs from the aforementioned device in that the traveling fulcrum point is not entirely linear throughout its traverse. Also, in the present invention the primary mechanical advantage is achieved when the traveling fulcrum point comes to rest, whereas in the device of U.S. Pat. No. 4,442,581, the mechanical motion stops whenever the traveling fulcrum denoted by numeral 44 reaches either end of the sliding chamber that guides the fulcrum 44. Further, the present invention does not have the disadvantage associated with hydraulically activated devices.

SUMMARY OF THE PRESENT INVENTION

Although the present invention is described in the context of a pneumatic piercing tool or punch, it will be apparent from a detailed perusal hereof that the mechanical force enhancer of the present invention is amenable to a wide variety of other applications.

The present invention may be described as a force enhancer for use in any application where a tool must travel a considerable distance under the influence of a moderate load; then during the final stage of its travel the tool is subjected to a large force, enabling the tool to perform useful work on a workpiece.

The invention includes a pneumatic actuator mounted at one end of a pair of spaced apart side plates. The actuator rod projects between the side plates and is attached to a slide block which in turn is attached to a clevis plate having a cam slot therein. The slide block moves linearly in a set of guideways or grooves that are positioned in the side plates and oriented parallel to the cylinder rod. An interconnecting link has a cam follower attached to one end thereof that interacts with a cam groove contained within the clevis plate. The interconnecting link has affixed thereto at its central portion a cam follower that tracks in a cam surface machined in one of the side plates. The end of the interconnecting link most remote from the clevis plate contains a transversely positioned fulcrum pin that interacts with a stop attached to a spacer, thus permitting the fulcrum pin to become a pivot point to change its direction of travel and enter a slot that is essentially perpendicular to the longitudinal axis of the actuator rod. The fulcrum pin containing the end of the connector link is in turn pivotally attached through a pivot axle to one end of a reciprocation ram. As the fulcrum pin lodges in the slot provided for it, the interconnecting link is then in a position to deliver a load of large magnitude to the ram which in turn contains a work producing tool attached at the end of the ram opposite the interconnecting link coupling. The tool containing ram slides in a pair of guideways or grooves positioned within the side plates.

The invention described above permits a tool containing ram to have a large amount of stroke or linear movement, enabling it to clear a workpiece, yet during the final traverse of its travel, the ram can deliver a load of high magnitude while the ram travel is held to a minimum.

A primary object of the present invention is to provide a mechanical force enhancer that utilizes a pneumatic power source yet is compact enough for versatile use in the work place.

Another object of the present invention is to create a tool that can deliver a work producing force comparable to that found in hydraulic devices yet operate on an air supply present in typical industrial locations.

A further object of the present invention is to provide a piercing tool that is operated by a reciprocating ram that acts under a plurality of selective load conditions.

Another object of the present invention is to provide a linkage between the tool carrying ram and the pneumatic actuator that permits the ram to travel a large distance under the influence of a small force, then travel a short distance under the influence of a greatly increased force.

Still another object of the present invention is to provide a means for monitoring the amount of force that is being delivered by the pneumatic actuator.

A further object of the present invention is to provide a tool wherein those parts that are prone to high wear can be easily replaced.

Further objects and advantages of the present invention will become apparent from the following description and the appended claims, reference being made to the accompanying drawings that form a part of this specification, where like reference characters designate corresponding parts in the several views.

DETAILED DESCRIPTION OF THE PREFERRED EMBODIMENT

Figure 1:
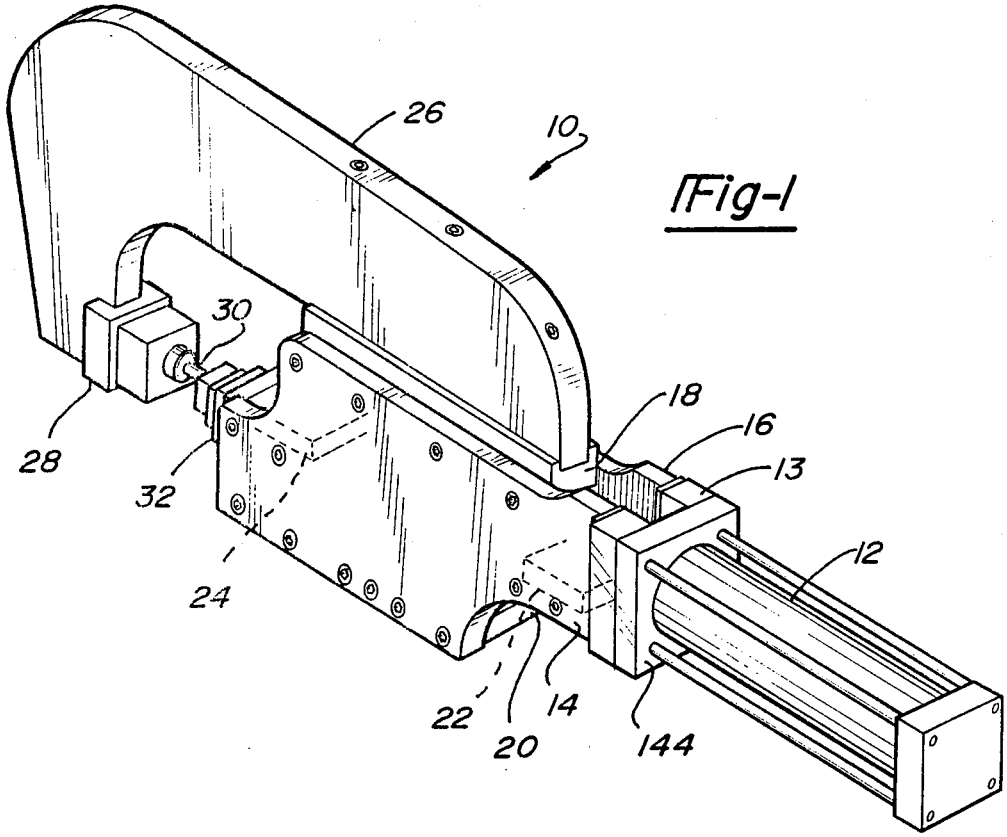
FIG. 1 is a perspective view of the present invention in the form of a punch and die combination.

Referring now to the drawings and more particularly to FIG. 1, one application of a mechanical force enhancer that encompasses the embodiment of the present invention is illustrated. The embodiment shown in FIG. 1 is in the form of a pneumatic pierce utilized in the punching of holes in one or more thicknesses of sheet metal or similar sheet material.

In FIG. 1, the numeral 10 represents the overall apparatus that contains the present invention. The overall apparatus 10 is pneumatic pierce unit, more commonly referred to as a piercing unit. The overall apparatus 10 has a pneumatic cylinder 12 that is powered by a fluid, such as air. The pneumatic cylinder 12 is attached to an adapter plate 13 that spans a pair of parallelly disposed side plates 14 and 16. The side plates 14 and 16 are held in spaced apart relationship to one another by a series of spacers. A top spacer 18 traverses nearly the entire length of the side plates 14 and 16. In a similar manner, a bottom spacer 20 provides support for the bottom edges of the side plates 14 and 16. Additional rigidity is afforded by intermediate spacers 22 and 24. All of the above mentioned spacers are preferably attached to the side plates 14 and 16 by fasteners, such as bolts. Such an arrangement permits ready disassembly of the overall apparatus 10 as required. A C-frame or support 26 is attached to and arranged perpendicular to the upper surface of the top spacer 18. The C-frame 26 is projected forward in cantilevered fashion and contains attached thereto a die button and a retainer backing plate 28. The die button and retainer backing plate 28 is in axial alignment with a ball lock punch 30 that is affixed to a ram 32 by means of a ball lock retainer set 34.

Figure 2:
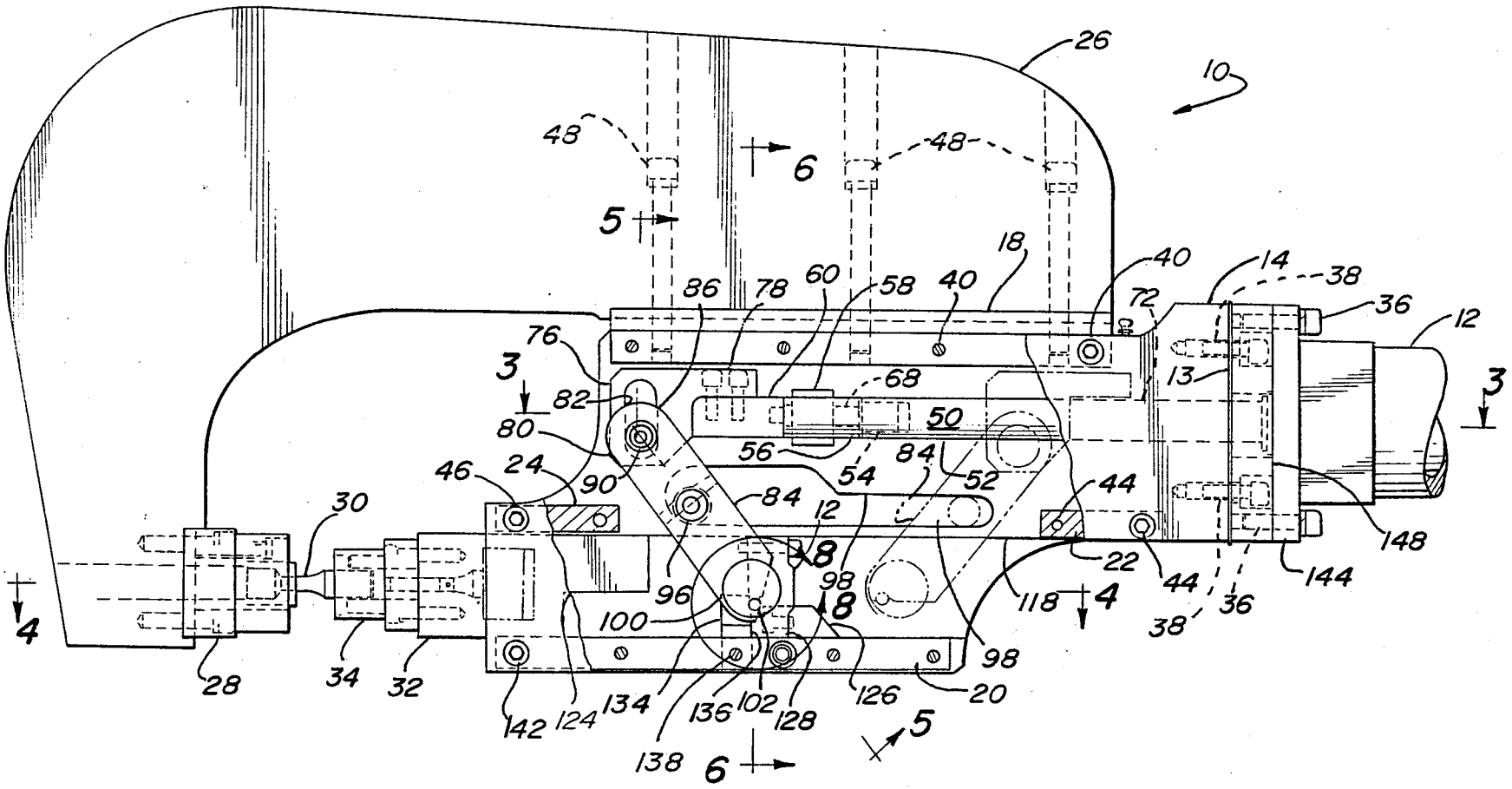
FIG. 2 is a broken away side view, partly in section, which shows the movable parts of the invention and their extent of travel.

FIG. 2, which is a broken away side view of the overall apparatus 10, depicts the movable parts of the invention and their paths of travel. The pneumatic cylinder 12, which is shown on the right-hand side of FIG. 2, is attached to the adapter plate 13 by bolts 36. The adapter plate 13 is in turn firmly anchored to the side plates 14 and 16 by bolts 38. The top spacer 18 is attached to the side plates 14 and 16 by bolts 40. In similar fashion, the bottom spacer 20 is attached to the lower edge of the side plates 14 and 16 by bolts, such as 42. The intermediate spacers 22 and 24 are attached to the side plates 14 and 16 by bolts 44 and 46. The C-frame 26 may be aligned perpendicular to the top surface of the top spacer 18 and the C-frame 26 may be parallel to the side plates 14 and 16. The C-frame 26 is held in position by bolts 48 which are anchored to the top spacer 18.

The pneumatic cylinder 12 has an axially extending rod 50 that is adapted for axial movement in both directions. Such movement of the rod 50 is achieved through the action of a piston (not illustrated) contained within the pneumatic cylinder. An end 52 of the rod contains an axially extending bore 54 that is threaded over the majority of its extent. A load cell 56 has a threaded shaft that coacts with the threads in the bore 54. The load cell 56 contains an enlarged square shaped end 58 that is opposite the threaded shaft that threads into the threads in the bore 54 of the end 52 of the rod 50.

Figure 3:
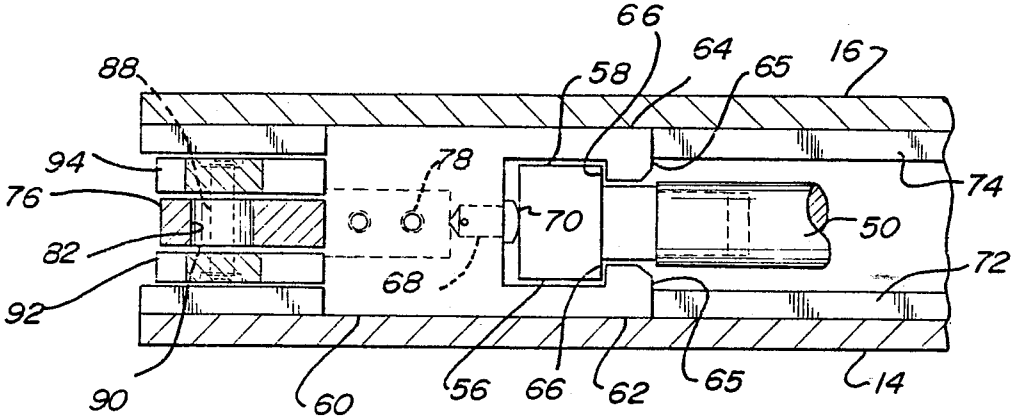
FIG. 3 is an enlarged broken sectioned view taken along line 3—3 of FIG. 2 that shows the pneumatic cylinder rod and the parts attached thereto.

A slide bar 60 is positioned adjacent to the load cell 56. The slide bar 60 partially encompasses the square shaped end 58 of the load cell 56. The slide bar 60 can be best seen in FIG. 3. The slide bar 60 has a bifurcated end with arms 62 and 64 extending around the square shaped end 58 of the load cell 56. Each one of the arms 62 and 64 has an inwardly projecting block 65 that fits into a reentrant portion 66 of the load cell 56. The interlocking arrangement, just described, between the slide bar 60 and the load cell 56 permits ready assembly yet provides a positive coupling between the slide bar 60 and the load cell 56 when loads are applied in an axial direction that is common to the rod 50. A centering button 68 is attached to the central portion of the slide bar 60. The centering button 68 has a spherical end surface 70 that makes a point contact with the surface of the load cell 56. This arrangement is a common method of assuring that the loads transmitted between the slide bar 60 and the load cell 56 will be essentially axial during the forward or compressive cycle of the rod 50. During the retractive cycle of the rod 50, the arms 62 and 64 bear against the reentrant portion 66 of the load cell 56 as shown in FIG. 3.

The slide bar 60 is positioned in and adapted to slide in an axial direction along grooves or guideways 72 and 74. The groove 72 is positioned in the inside wall of the side plate 14 and the groove 74 is likewise positioned in the inside wall of the side plate 16. The grooves 72 and 74 extend the length of the slide plates 14 and 16 and the grooves 72 and 74 are parallel to the rod 50 of the pneumatic cylinder 12.

A clevis bar 76 is aligned along the longitudinal axis of the slide bar 60 and is attached thereto by bolts 78. The clevis bar 76 contains an arm portion 80 extends downward as can be best seen in FIG. 2. The arm portion 80 locates against the end of the slide bar 60 and is mounted thereto by bolts. A vertically extending cam slot 82 traverses the arm portion 80 of the clevis bar 76.

Figure 5:
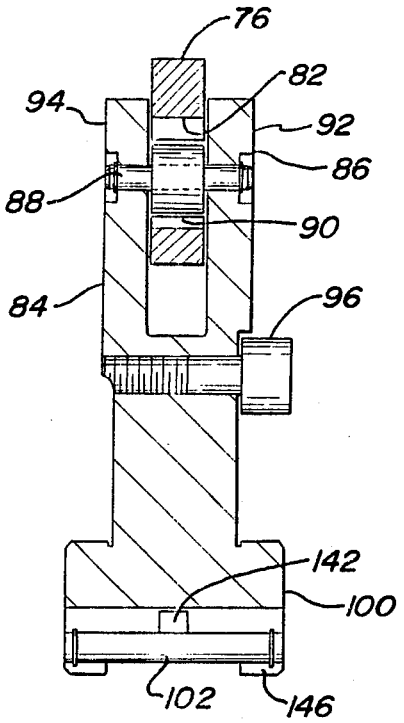
FIG. 5 is an enlarged sectioned view taken along line 5—5 of FIG. 2 that shows the interconnecting link and the parts connected thereto.
Figure 6:
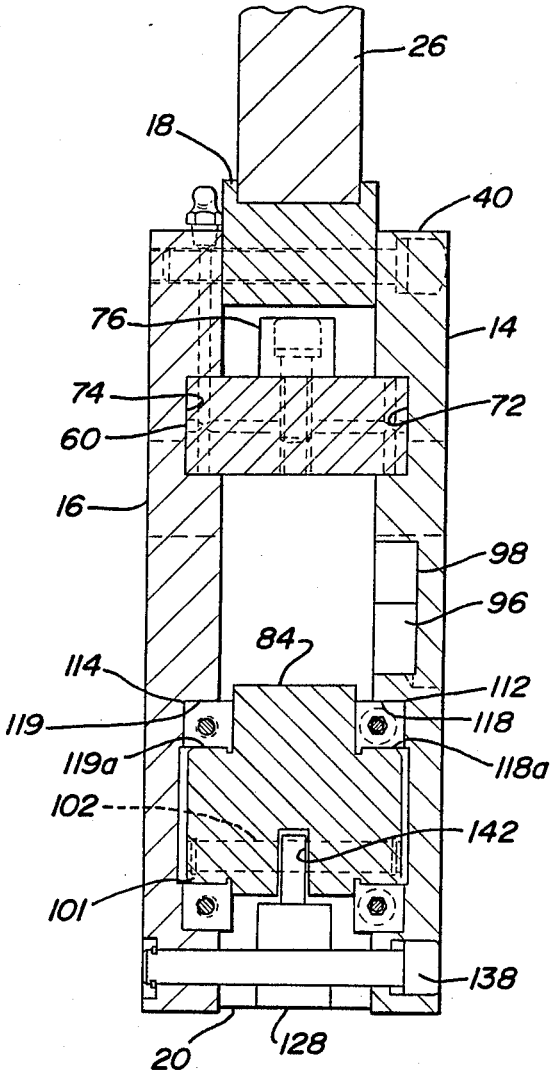
FIG. 6 is an enlarged view shown in section, taken along the line 6—6 in FIG. 2 that shows the side plates and their interaction with the moving parts contained therebetween.

An interconnecting link or lever arm 84 contains an upper end 86 that is bifurcated. The interconnecting link 84 can be seen in cross-section in FIG. 5. A pin 88 is utilized to position a cam follower 90 between arms 92 and 94 of the upper end 86 of the interconnecting link 84. The cam follower 90 is assembled so that it rides within the cam slot 82 of the clevis bar 76. The interconnecting link 84 has a cam follower 96 that is positioned in the central section thereof. The cam follower 96 is positioned on one side of the interconnecting link 84 as viewed in FIG. 2. The cam follower 96 rides along a cam groove 98 that is machined into the inside face of the side plate 14 as shown in FIG. 6. The actual configuration of the machined cam groove 98 is shown by a dotted line in FIG. 2. The end of the machined cam groove 98 nearest the pneumatic cylinder 12 is narrow and the opposite end is considerably wider for a reason to be explained hereinafter. The lower end of the interconnecting link 84 has as an integral part thereof a pivot axle 100 disposed perpendicular to the longitudinal axis of the interconnecting link 84. A fulcrum pin 102 is positioned relative to the pivot axle 100 so that its longitudinal axis is parallel to the axis of the pivot axle 100. The fulcrum pin 102 also passes across the main body portion of the interconnecting link 84. The fulcrum pin 102 has part of its exterior surface exposed as it traverses the main body portion of the interconnecting link 84. The exposed portion of the fulcrum pin 102 can best be seen in FIGS. 5 and 7. The fulcrum pin 102 is immobilized within the pivot axle 100 by retaining rings 101. Because of the high loads that are experienced by the fulcrum pin 102, it is made from high grade steel so that a hard surface can be maintained thereon.

FIG. 3, which is a broken sectioned view taken along line 3—3 of FIG. 2, shows the interconnection between the upper end 86 of the interconnecting link 84 and the clevis bar 76. The clevis bar 76 is positioned between the arms 92 and 94 of the interconnecting link 84 and the pin 88 is used to locate the cam follower 90 within the cam slot 82.

Figure 7:
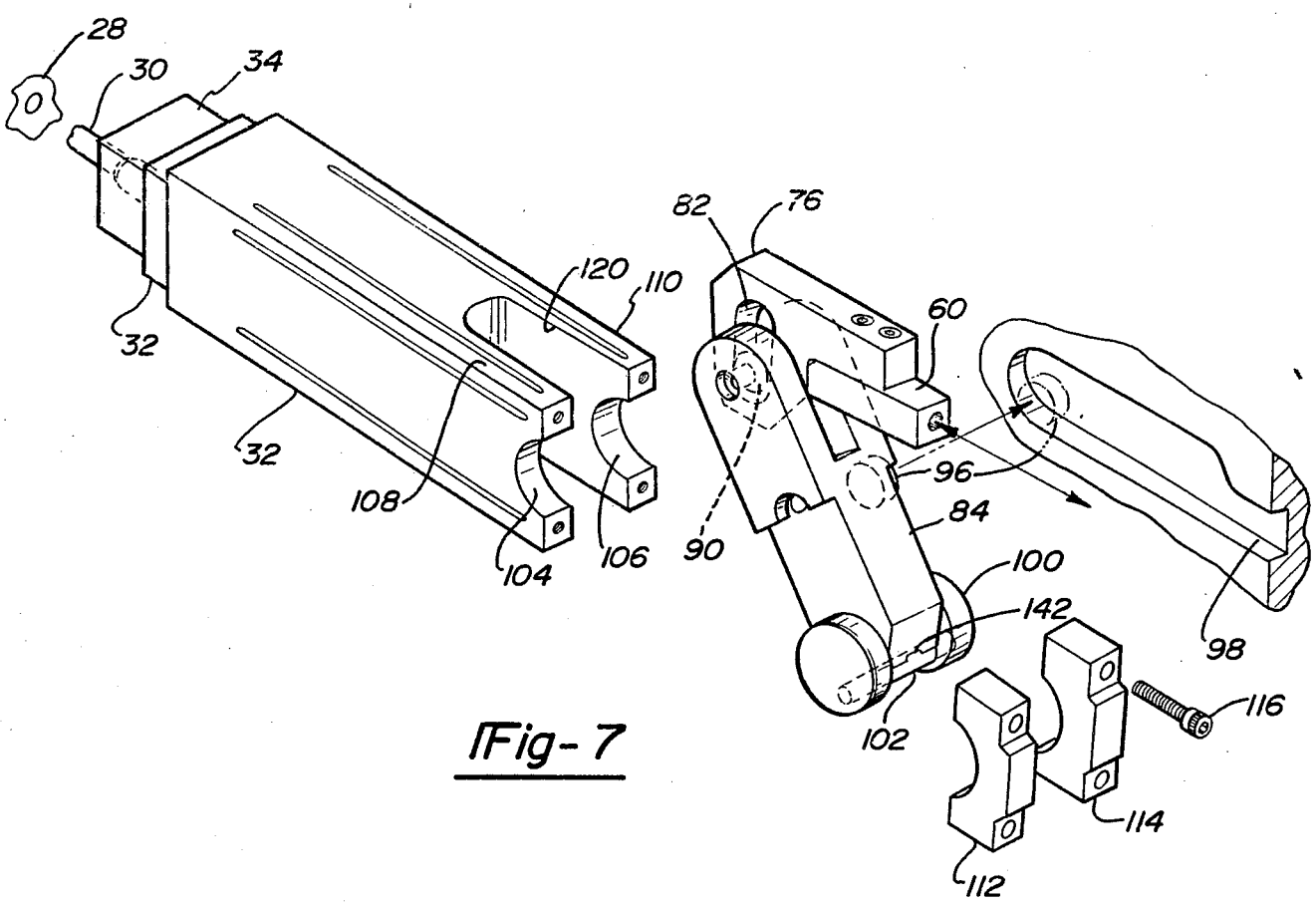
FIG. 7 is an exploded perspective view of one end of the ram and its attachment to the interconnecting link.

As shown in FIG. 7, the pivot axle 100 of the interconnecting link 84 is contained at either end thereof in cylindrical bearing seats 104 and 106 which are formed in clevis ends 108 and 110 of the ram 32. Also depicted in FIG. 7 are axle retaining blocks 112 and 114 which abut the clevis ends 108 and 110 of the ram 32. Fasteners such as bolts 116 are utilized to position the retaining blocks 112 and 114 on the clevis end of the ram. Thus, it becomes evident that the pivot axle 100 of the interconnecting link 84 can rotate freely within the bearing surfaces provided by the bearing seats 104 and 106 and the mating retaining blocks 112 and 114.

Figure 4:
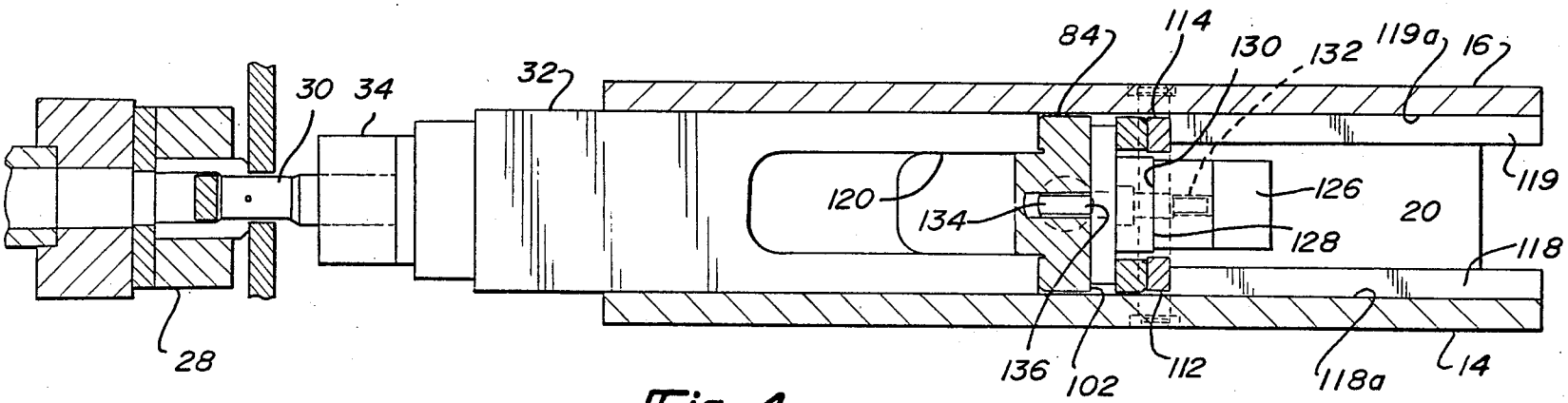
FIG. 4 is an enlarged view taken along line 4—4 of FIG. 2, with the ram and its associated interacting parts shown in section.

FIGS. 2, 4 and 7 show most clearly the ram 32 which has been heretofore mentioned. The ram 32 is positioned so that its longitudinal axis is parallel to the axis of the rod 50 of the pneumatic cylinder 12. The ram 32 is positioned within guideways or grooves 118, **118*a*, 119 and 119*a*, which are machined in the inside faces of the side plates 14 and 16. The ram assembly, including the retaining blocks 112 and 114, is free to move along the longitudinal extent of the guideways or grooves 118, 118*a*, 119, and 119*a***.

FIG. 4, which is a sectioned view taken along line 4—4 of FIG. 2, shows the bottom surface of the grooves 118 and 119 with the ram 32 positioned therein between. Since the interconnecting link 84 must articulate through an angular extent, a cavity 120 is provided between the clevis ends 108 and 110 to provide clearance for articulation of the interconnecting link 84 as the piston rod moves from one extent to an opposite extent of the ram 32.

FIG. 4 also shows the bottom spacer 20 in position between the side plates 14 and 16. The bottom spacer 20 contains an upwardly cantilevered boss 126 that is firmly attached to the bottom spacer 20. The boss 126 may be machined as an integral part of the bottom spacer 20 or other means of firmly attaching it to the bottom spacer 20 may be employed. The boss 126 is aligned along the centerline of the bottom spacer 20 as shown in FIG. 4. A wear bar 128 abuts against a vertically aligned surface 130 of the boss 126. The wear bar 128 is attached to the boss 126 by a fastener, such as a screw 132. As an alternative, the wear bar 128 and the boss 126 assembly can be positioned within a slot (not shown) within the bottom spacer 20 and held rigidly in position by appropriate fasteners. Such an arrangement would provide for rapid replacement of the wear bar 128 which is subjected to high load concentrations. The bottom spacer 20 also contains a striker bar 134 as shown in FIG. 2. The striker bar 134 is positioned in spaced relationship with respect to the front surface of the wear bar 128. A well defined groove 136 is, thus, provided by the spacing of the striker bar 134 and the wear bar 128 for a reason hereinafter explained. Since the striker bar 134 is a critical high stress component, an arrangement has been provided for its ready replacement without the necessity of dismantling the overall apparatus 10. The base portion of the striker bar 134 may be cylindrical or rectangular in configuration. The striker bar 134 extends through the bottom spacer 20 as shown in FIG. 2 which provides easy access for replacement. A fastener, such as bolt 138, is employed to firmly anchor the striker bar 134 with respect to the bottom spacer 20.

Figure 8:
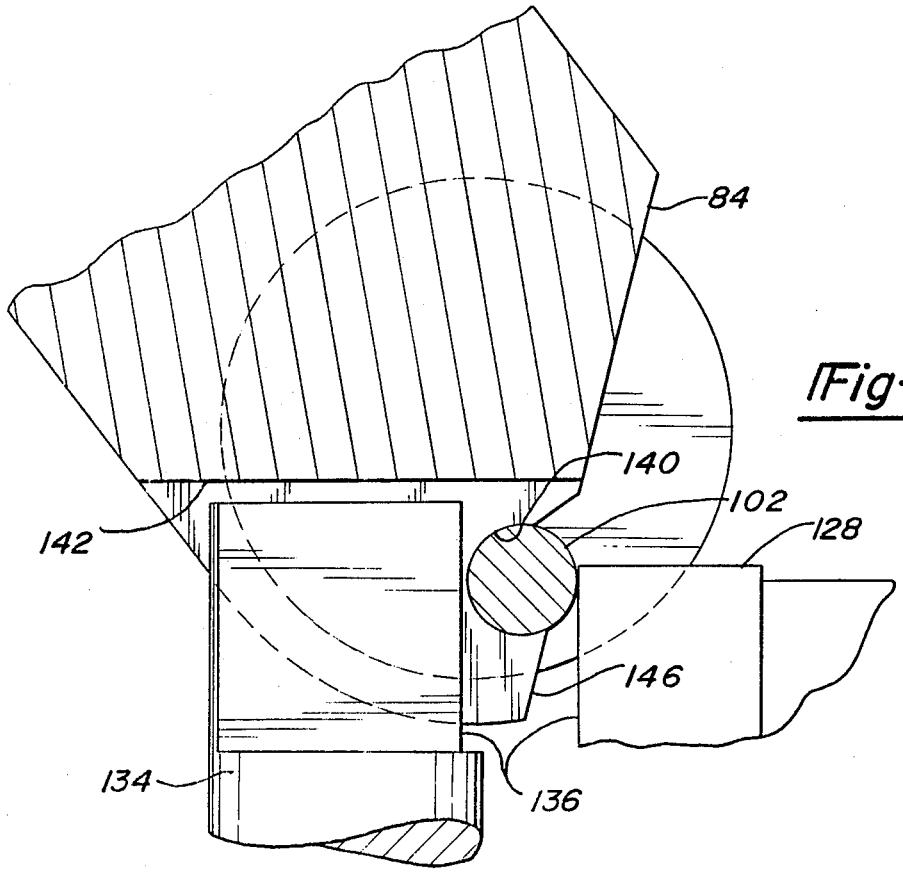
FIG. 8 is a magnified view of the structure that is shown within the reference circle 8—8 as shown in FIG. 2.

FIG. 8 is an enlarged view shown partly in section taken along the circular extent defined by reference circle 8—8 as depicted in FIG. 2 with the side plate 14 removed. The interconnecting link 84 is shown in cross-section as is the fulcrum pin 102. The fulcrum pin 102 slip fits into a cylindrical bore 140 that is positioned normal to the longitudinal axis of the interconnecting link 84. As can be seen in FIG. 8, the central section of the bore 140 has part of its sidewall removed to form a reentrant portion 146, permitting a considerable portion of the exterior surface of the fulcrum pin 102 to be exposed as also shown in FIG. 7. An additional area of the fulcrum pin 102 is exposed by a slot 142 that is positioned in the end of the interconnecting link 84. The slot 142 is positioned on the centerline between the extremities of the pivot axle 100 that forms a portion of the lower end of the interconnecting link 84. The slot 142 is of sufficient width and depth to clear the striker bar 134. Thus, the slot 142 provides for exposure of a minor portion of the exterior surface of the fulcrum pin 102 and the previously mentioned reentrant portion 146 provides for a major portion of the external surface of the fulcrum pin 102 to be exposed.

FIG. 8 further shows the groove 136 that is formed by the spaced apart relationship of the wear bar 128 and the striker bar 134. The groove 136 permits the fulcrum pin 102 to enter therein without actual binding therein.

Returning once again to FIGS. 2 and 6 it can be seen that the striker bar 134 protrudes upwardly into the same space occupied by the ram 32. Thus, the groove 124 in the ram 32 has been provided along the bottom of the ram 32 to provide clearance for the striker bar 134 as well as the wear bar 128 and its backup boss 126.

OPERATION AND ASSEMBLY

During the assembly of the overall apparatus 10, the load cell 56 can be fastened to the end of the rod 50 that is a part of the pneumatic cylinder 12. The clevis bar 76 can then be secured to the slide bar 60 by the bolts 78. The square end 58 of the load cell 56 can be moved into position between the blocks 65 of the arms 62 and 64 of the slide bar 60. The above described subassembly can then be installed in the grooves 72 and 74 which have already been placed in a spaced apart position by the installation of the top spacer 18 and the intermediate spacer 22 between the side plates 14 and 16. A flange 144 of the pneumatic cylinder 12 is then bolted to the end plate 13 by the bolts 36 with an insulator 148 therebetween. The interconnecting link 84 is then attached to the end of the ram 32 as are the retaining blocks 112 and 114, and the bolts 116 are utilized to immobilize the retaining blocks 112 and 114. The ram 32 and its associated parts is then positioned in the grooves 118, 118*a*, 119 and 119*a* which are machined in the respective side plates 14 and 16. The intermediate spacer 24 and the bottom spacer 20 can be installed by means of the bolts 46 and 42. The cam followers 90 and 96 can then be installed in the interconnecting link 84 through access holes located in one or both side plates 14 and 16. The actual location of the access holes is not shown in the drawings. Likewise, the fulcrum pin 102 can be installed in the bore 140 of the interconnecting link 84 before the interconnecting link 84 has been positioned within the overall apparatus 10.

One of the objectives of the present invention is to provide a tool that can move rapidly into and out of position with respect to a workpiece, yet have sufficient power to do useful work on the workpiece. The following operative steps of the invention will point out how the overall apparatus 10 meets the heretofore expressed objectives of the invention. The method of operation is set forth in the following paragraphs.

The pneumatic cylinder need not be described in detail since it is conventional in that a piston is attached to the rod 50. The piston and the accompanying rod 50 moves in one direction or another depending on which side of the piston a fluid such as air is introduced. In the start position of the present device, the rod 50 is retracted into the pneumatic cylinder 12 until the interconnecting link 84 assumes the position shown by the phantom lines in FIG. 2. At this position the cam follower 96, which is attached to the interconnecting link 84, is riding on the lower surface of the cam groove 98. The exposed surface of the fulcrum pin 102 is not in contact with any adjacent components of the overall apparatus 10. Also, the cam follower 90, which is located toward the upper end of the interconnecting link 84, is positioned in the lower portion of the cam slot 82. The ram 32 has moved to the right, as viewed in FIG. 2 providing ample room for the insertion of a workpiece between the ball lock punch 30 and the die button and retainer backing plate 28. In the alternative, the complete apparatus may be moved into position over a sheet metal assembly which requires a pierced hole by the use of some form of lift device (not shown) from which the whole apparatus 10 may be suspended. As air is introduced behind the piston within the pneumatic cylinder 12, the rod 50, the interconnecting link 84, and the ram 32 all move at any selected speed toward the left as shown in FIG. 2. The selected movement of the aforementioned components continues until the fulcrum pin 102 contacts the face of the striker bar 134 and drops into the groove 136, as shown in FIG. 8. Since the lower end of the interconnecting link 84 is now trapped in the groove 136 and cannot move further to the left after the fulcrum pin 102 is loaded between the striker bar 134 and the wear bar 128, the interconnecting link 84 rotates about the pivot axle 100 and the and fulcrum pin 102 to a vertical position and ultimately assumes a negative slope as it reaches the end of its travel. The ram 32 has now traversed most of its distance of travel thus permitting the tip of the ball lock punch 30 to enter the workpiece and pierce a hole therein.

As the fulcrum pin 102 contacts the face of the striker bar 134, the fulcrum pin 102 begins to move in a downward direction into the groove 136. The fulcrum pin 102 penetrates the groove 136 until its surface fully contacts the face of the wear bar 128. Immediately, the fulcrum pin 102 becomes the fulcrum point for a large mechanical force that is delivered to the ram 32. The large force is generated because the bottom of the interconnecting link 84 has become fixed in its heretofore translatory movement, whereas, the top of the interconnecting link 84 is still moving under the influence of the extension of the rod 50 from within the pneumatic cylinder 12. By way of example, the distance from the fulcrum to the line of force delivered by the rod 50 to the upper end of the interconnecting link 84 is approximately ten times the distance from the fulcrum to the line of force that is delivered to the ram 32. Thus, the ram 32 is slowly moving to the left under the influence of a force along the central axis of the ram 32 that is approximately ten times greater than the force generated by the extending piston rod 50.

Returning now to the moment when the fulcrum pin 102 contacts the striker bar 134, the cam follower 96 has entered that portion of the cam groove 98 where the cam groove 98 has widened, thus the cam follower 96 is free to traverse an arcuate path as the interconnecting link 84 rotates about the fulcrum pin 102. As the cam follower 96 begins its arcuate travel, the cam follower 90 begins a linear ascent and descent through the cam slot 82 that is positioned in the clevis bar 76.

Thus, the overall apparatus 10 utilizes a pneumatic power source to move the ram 32 under a plurality of load conditions. First, the ram 32 moves at a selective speed under a relatively small load that is essentially of a magnitude equal to the load generated by the rod 50 of the pneumatic cylinder 12. Second, as the fulcrum pin 102 contacts the striker bar 134, the ram 32 decelerates to a much slower movement, however, the load delivered has increased approximately ten times due to the relationship of the point at which the load is applied to the interconnecting link 84 and the point at which the ram 32 is attached to the interconnecting link 84 through the pivot axle 100.

In order to monitor the actual loads encountered by the ball lock punch 30, the overall apparatus has been equipped with a load cell 56 that is positioned so as to detect the compressive forces that occur as the rod 50 moves in an outward direction from the pneumatic cylinder 12. Also, the load cell can be used to detect whether the ball lock punch 30 has made actual contact with the workpiece. The detection and sensing of whether a workpiece is present and in a proper position is increasingly important as automation becomes more of a reality.

While a hydraulic cylinder employing a liquid, such as for example oil, could be used with the present invention, the disadvantages of a liquid based force generating system become readily apparent. A liquid fed hydraulic cylinder must employ a reservoir for the retention of the liquid. Also, an auxiliary power source such as electricity must be supplied to run the pump that delivers the liquid to the hydraulic cylinder. Then, too, the portability of the overall apparatus 10 is diminished and made cumbersome. Another reason for utilizing a fluid such as air is its accessibility as well as that there is no cleanup required as is nearly always the situation involving the use of a liquid, such as oil. The overall apparatus 10 is as compact as heretofore known hydraulic devices and can be powered by coupling the pneumatic cylinder valving mechanism (not shown) directly to a factory air supply that is normally routed to all locations throughout the factory. The overall apparatus 10 can, while using 80 p.s.i. (550 kilopascals) air pressure, pierce an oblong hole 0.338 inch (8.6 mm) by 0.590 inch (15 mm) through 0.059 inch (1.5 mm) ferrous material that has a tensile strength of 70,000 p.s.i. (4921 $Kg/cm^2$).

It is also to be noted that the overall apparatus 10 can easily be adapted to an application which requires a longer stroke by merely increasing the overall length of the side plates 14 and **1*b*** and associated spacers and C-frame and utilizing a cylinder with an appropriately longer stroke.

The present invention is not intended to be restricted to any particular arrangement, or to any specific embodiment disclosed herein, or to any specific use with any specific material, since the same may be modified in various particulars or relations without departing from the spirit or scope of the claimed invention hereinabove shown and described. The overall apparatus shown is intended only for illustration and for disclosure of any operative embodiment, and not to show all of the various forms of modification in which the present invention may be embodied as set forth in the claims.

The invention set forth above has been described in considerable detail as to structure and function in order to comply with a full public disclosure of at least one of its embodiments. The detailed description is not intended in any way to limit the features or principles of the invention, or limit the scope of the patent protection afforded by the following claims.

What is claimed is:

1. A mechanical force enhancer for use with a tool that performs work on a workpiece comprising:

a fluid driven cylinder having a piston driven rod, said piston driven rod being capable of linear motion in more than one direction;

a pair of spaced apart side support plates for supporting said fluid driven cylinder containing said piston driven rod therebetween, said pair of spaced apart side support plates having integral guide means;

a slide bar coupled to said piston driven rod for linear movement along said integral guide means of said pair of spaced apart side support plates;

cam means attached to one end of said slide bar;

a ram positioned in said integral guide means of said pair of spaced apart side support plates, said ram being added for reciprocal linear movement in said guide means;

interconnecting means having one end and an opposite end, said opposite end being coupled to said cam means, said one end selectively communicating with said ram so that the movement of said piston driven rod is transmitted to said ram;

a bottom spacer spanning the distance between said pair of spaced apart side support plates and rigidly attached thereto;

stop means attached to said bottom spacer, said stop means defining a groove for interaction with said one end of said interconnecting means; and means associated with said one end of said interconnecting means to interact with said groove defined by said stop means, whereby the force delivered by said piston driven rod is amplified and delivered to said ram.

2. The mechanical force enhancer as claimed in claim 1 further comprising:

a plurality of spacers mounted between said pair of spaced apart side support plates, at least one of said plurality of spacers being said bottom spacer;

an end plate attached to one end of said pair of spaced apart side support plates, said fluid driven cylinder being attached to said end plate; and wherein said integral guide means comprises a first guide means located along an inside surface of each of said pair of spaced apart side support plates; and second guide means being positioned in spaced relation to said first guide means, said second guide means being adapted to receive said ram therein.

3. The mechanical force enhancer as claimed in claim 1 wherein said stop means further comprises:

a striker bar mounted to said bottom spacer, a wear bar attached to said bottom spacer a predetermined distance from said striker bar, said striker bar and said wear bar being arranged in spaced relationship to one another so as to define said groove for interaction with said one end of said interconnecting means;

said ram having a tool mounted to one end and journaling means mounted to an opposite end thereof; and pivot means complementary with said one end of said interconnecting means to interact with said groove defined by said striker bar and said wear bar, whereby a linear force delivered by said piston driven rod as said piston rod moves in one direction is increased in magnitude and applied by said ram to said tool mounted to said one end thereof.

4. The mechanical force enhancer as claimed in claim 2 wherein said first and second guide means are arranged parallel to the orientation of said piston driven rod.

5. The mechanical force enhancer as claimed in claim 3 wherein said interconnecting means comprises an interconnecting link having one end coupled to said cam means and an opposite end coupled to said journaling means of said ram so that the movement of said piston driven rod is transmitted to said ram; and means attached to one end of said interconnecting link to selectively interact with said groove that is defined between said striker bar and wear bars, whereby a force delivered by said piston driven rod is increased in magnitude and delivered to said tool through said ram.

6. A mechanical force enhancer for use with a tool that performs work on a workpiece comprising:

a fluid cylinder having a piston driven rod capable of reciprocating linear motion;

a pair of side plates held in spaced apart relationship to one another;

a plurality of spacers, including a bottom spacer attached to and spanning the distance between said pair of side plates;

an end plate mounted to one end of said pair of side plates;

said fluid cylinder being attached to said end plate so that said piston driven rod extends between said pair of side plates;

said pair of side plates having two sets of complementary guide grooves therein;

a slide bar coupled to one end of said piston driven rod for linear reciprocal movement along one of said two sets of complementary guide grooves of said pair of side plates, said one of said two sets of complementary guide grooves being arranged parallel to the orientation of said piston driven rod;

a cam bar attached to one end of said slide bar, said cam bar containing a cam slot therein;

a ram positioned for reciprocating linear movement in the other of said two sets of complementary guide grooves contained in said pair of side plates, said ram having a tool affixed at one end and journaling means attached to the other end thereof;

an interconnecting link having one end coupled to said cam bar and an opposite end coupled to said journaling means of said ram so that the movement of said piston driven rod is transmitted to said ram, said interconnecting link having a cam follower mounted in said cam slot of said cam bar;

cam follower means positioned intermediate said one end and said opposite end of said interconnecting link, said cam follower means being adapted to guide the movement of said interconnecting link;

a cam groove positioned in one of said pair of side plates for interaction with said cam follower means;

a striker bar mounted to said bottom spacer in spaced relation to said journaling means of said ram;

a wear bar attached to said bottom spacer adjacent said striker bar so as to define a predetermined groove therebetween, said predetermined groove between said striker and said wear bars being spaced a predetermined distance with respect to an inside surface of said bottom spacer; and means attached to one end of said interconnecting link to selectively interact with said predetermined groove that is formed between said striker bar and said wear bar, whereby a force delivered by said piston driven rod is increased in magnitude and delivered to said tool through said ram to said work performing tool.

7. The mechanical force enhancer as claimed in claim 6 wherein said pair of side plates are spaced apart in parallel relationship to one another.

8. The mechanical force enhancer as claimed in claim 7 wherein said piston driven rod extends between said pair of side plates in parallel orientation therewith.

9. The mechanical force enhancer as claimed in claim 6 wherein said fluid cylinder is a pneumatic cylinder.

10. The mechanical force enhancer as claimed in claim 6 wherein said interconnecting link further comprises:

a bifurcated upper end defining a pair of cantilevered arms, said cam follower being mounted between said pair of cantilevered arms for interaction with said cam slot of said cam bar.

11. The mechanical force enhancer as claimed in claim 10 wherein said piston driven rod extends between said pair of side plates in parallel orientation therewith.

12. The mechanical force enhancer as claimed in claim 11 wherein said piston driven rod extends between said pair of side plates in parallel orientation therewith.

13. The mechanical force enhancer as claimed in claim 6 wherein said pair of side plates are rectangular.

14. The mechanical force enhancer as claimed in claim 13 wherein said pair of side plates are spaced apart in parallel relationship to one another.

15. The mechanical force enhancer as claimed in claim 10 wherein said pair of side plates are spaced apart in parallel relationship to one another.

16. The mechanical force enhancer as claimed in claim 15 wherein said pair of side plates are rectangular.

17. The mechanical force enhancer as claimed in claim 8 wherein said interconnecting link further comprises:

a bifurcated upper end defining a pair of cantilevered arms, said cam follower being mounted between said pair of cantilevered arms for interaction with said cam slot of said cam bar.

18. The mechanical force enhancer as claimed in claim 2 wherein said pair of spaced apart side support plates are rectangular.

19. The mechanical force enhancer as claimed in claim 2 wherein said piston driven rod extends between said pair of spaced apart side support plates in parallel orientation therewith.

20. The mechanical force enhancer as claimed in claim 19 wherein said pair of side plates are spaced apart in parallel relationship to one another.

21. A mechanical punch for forming apertures in a workpiece such as sheet material comprising:

a pneumatic cylinder that has a piston driven rod cantilevered from one end, said piston driven rod being capable of reciprocating linear motion;

a pair of side plates held in spaced apart parallel relationship to one another;

a plurality of spacers mounted to said pair of side plates to provide stability to said pair of side plates, said plurality of spacers including a bottom spacer aligned generally parallel to said piston driven rod; a top spacer aligned generally parallel to said bottom spacer, and an end plate attached to and spanning the distance between said pair of side plates, said pneumatic cylinder being attached to said end plate so that said piston driven rod extends between said pair of side plates in parallel orientation therewith;

a curved support anvil in the form of a plate attached to a surface on said top spacer, said support anvil aligned parallel to said pair of side plates, said support anvil extending in cantilevered fashion beyond one end of said pair of side plates;

a slide bar coupled to the end of said piston driven rod for linear reciprocal movement; two sets of complementary grooves positioned in juxtaposed relationship to one another in said pair of side plates, said one of said two sets of complementary grooves being arranged parallel to the orientation of said piston driven rod;

a cam containing bar attached to said slide bar on the end thereof most remote from said piston driven rod, said cam containing bar having a cam slot that traverses one end of said cam containing bar in a direction generally perpendicular to said piston driven rod;

a ram positioned for reciprocating linear movement in the other of said two sets of complementary grooves that are arranged juxtaposed to one another in said pair of side plates, said ram containing a tool affixed at one end, the opposite end of said ram terminating in a bifurcated end defining a plurality of bearing seats;

a die block attached to a reentrant portion of said curved support anvil, said die block having a centrally located aperture with an axis coincident with the axis of said ram;

retaining blocks attached in opposed relationship to each said bearing seat of said plurality of bearing seats, said retaining blocks defining a plurality of coaxial apertures in the opposite end of said ram;

an interconnecting link coupling said cam containing bar and said plurality of coaxial apertures in the end of said ram so that the movement of said piston driven rod is transmitted to said ram, said interconnecting link having a bifurcated upper end with a pair of cantilevered arms that contain a cam follower therebetween for interaction with said cam slot in said cam containing bar, said cam follower being rotatably fixed between said pair of cantilevered arms of said bifurcated upper end by a transversely oriented pin;

an axle formed as an integral part of said interconnecting link on the end of said interconnecting link opposite said bifurcated upper end, said axle arranged so that its axis is perpendicular to the longitudinal axis of said interconnecting link, said axle being adapted for rotary movement and confinement in said plurality of coaxial apertures formed between said retaining blocks and said bearing seats of said bifurcated end of said ram;

a fulcrum pin positioned between the ends of said axle, said fulcrum pin arranged parallel to the axis of said axle;

a cam follower of cylindrical configuration attached to and positioned intermediate the ends of said interconnecting link to guide said interconnecting link over a portion of its traverse;

a cam groove positioned in one of said pair of side plates for interaction with said cam follower; and a striker bar and a wear bar attached, in an outward cantilevered attitude, to said bottom spacer, said striker and said wear bars being positioned midway between said pair of side plates, said striker and said wear bars being arranged in spaced apart relationship to one another so as to define a groove therebetween, said groove between said striker and said wear bars being oriented perpendicular to the surface of said bottom spacer and said ram, whereby said fulcrum pin can enter said groove and interact with a surface of said wear bar thereby providing a fulcrum for increasing the force delivered by said piston driven rod to said tool through said ram.

22. The mechanical punch as claimed in claim 21 further comprising:

a slot positioned in said end of said interconnecting link adjacent said fulcrum pin, said slot exposing a minor portion of the surface of said fulcrum pin; a reentrant portion formed in said end of said interconnecting link between the extremities of said axle that exposes a major portion of the surface of said fulcrum pin; and wherein said cam groove further comprises:

a narrow section at one end of said cam groove, said narrow section restricting said cam follower to linear movement; and a wide section at an opposite end, said wide section permitting said cam follower to move through an arcuate path.

23. The mechanical punch as claimed in claim 21 further comprising:

a load cell attached to said cantilevered end of said piston driven rod; and a centering button attached to said slide bar and interposed between said slide bar and said load cell such that compressive loads generated by said piston driven rod will remain centered.

24. The mechanical punch as claimed in claim 23 further comprising:

a slot positioned in said end of said interconnecting link adjacent said fulcrum pin, said slot exposing a minor portion of the surface of said fulcrum pin; a reentrant portion formed in said end of said interconnecting link between the extremities of said axle that exposes a major portion of the surface of said fulcrum pin; and wherein said cam groove further comprises:

a narrow section at one end of said cam groove, said narrow section restricting said cam follower to linear movement; and a wide section at an opposite end, said wide section permitting said cam follower to move through an arcuate path.

* * * * *

UNITED STATES PATENT AND TRADEMARK OFFICE

CERTIFICATE OF CORRECTION

PATENT NO. : 4,932,128

DATED : June 12, 1990

INVENTOR(S) : Ernest A. Dacey, Jr.

It is certified that error appears in the above-identified patent and that said Letters Patent is hereby corrected as shown below:

Column 1, line 2, delete "BACKGROUND OF THE".

Column 1, line 3, delete in its entirety.

Column 1, before line 4, insert ---- BACKGROUND OF THE INVENTION ----.

Column 4, line 29, after "is" insert ---- a ----.

Column 5, line 40, delete "slide" and insert ---- side ----.

Column 5, line 45, after "80" insert ---- which ----.

Column 8, line 57, delete "and" second occurrence.

Column 10, line 7, delete "1b" and insert ---- 16 ----.

Column 11, line 26, after "piston" insert ---- driven ----.

Column 11, line 39, before "means" delete paragraph indention.

Column 14, line 53, insert another paragraph indention at beginning of line.

Column 14, line 56, insert another paragraph indention at beginning of line.

UNITED STATES PATENT AND TRADEMARK OFFICE

CERTIFICATE OF CORRECTION

PATENT NO. : 4,932,128

DATED : June 12, 1990

INVENTOR(S) : Ernest A. Dacey, Jr.

It is certified that error appears in the above-identified patent and that said Letters Patent is hereby corrected as shown below:

Column 16, line 2, insert another paragraph indention at beginning of line.

Column 16, line 5, insert another paragraph indention at beginning of line.

Signed and Sealed this

Sixteenth Day of June, 1992

*Attest:*

DOUGLAS B. COMER

*Attesting Officer*

*Acting Commissioner of Patents and Trademarks*